US005148869A

United States Patent [19]

Sanchez

[11] Patent Number: 5,148,869

[45] Date of Patent: Sep. 22, 1992

[54] SINGLE HORIZONTAL WELLBORE PROCESS/APPARATUS FOR THE IN-SITU EXTRACTION OF VISCOUS OIL BY GRAVITY ACTION USING STEAM PLUS SOLVENT VAPOR

[75] Inventor: J. Michael Sanchez, Carrollton, Tex.

[73] Assignee: Mobil Oil Corporation, Fairfax, Va.

[21] Appl. No.: 648,063

[22] Filed: Jan. 31, 1991

[51] Int. Cl.[5] ..... E21B 43/24

[52] U.S. Cl. ..... 166/303; 166/50; 166/306

[58] Field of Search ..... 166/50, 250, 252, 272, 166/303, 306

[56] References Cited

U.S. PATENT DOCUMENTS

| | | | |
|---|---|---|---|
| 4,067,391 | 1/1978 | Dewell | 166/303 |
| 4,085,803 | 4/1978 | Butler | 166/50 X |
| 4,099,570 | 7/1978 | Vandergrift | 166/50 X |
| 4,116,275 | 9/1978 | Butler et al. | 166/50 X |
| 4,344,485 | 8/1982 | Butler | 166/271 |
| 4,697,642 | 10/1987 | Vogel | 166/272 X |

*Primary Examiner*—George A. Suchfield
*Attorney, Agent, or Firm*—A. J. McKillop; C. J. Speciale; C. A. Malone

[57] ABSTRACT

A conduction heating, gravity assisted, single well, process for removing viscous hydrocarbonaceous fluids from a reservoir penetrated by a horizontal wellbore. Steam and a gas soluble in hydrocarbonaceous fluids are circulated into the wellbore at or below the reservoir pressure through an upper perforated conduit of the horizontal wellbore. Circulation is continued so as to allow steam to heat the reservoir by conductance while gas enters the hydrocarbonaceous fluids. Thus, heated hydrocarbonaceous fluids having a reduced viscosity flow from the reservoir around the horizontal wellbore where the fluids are produced to the surface by a lower conduit within the horizontal wellbore. The lower conduit is open along its length so as to be in fluid communication with the reservoir for the length of the horizontal wellbore.

12 Claims, 2 Drawing Sheets

SINGLE HORIZONTAL WELLBORE PROCESS/APPARATUS FOR THE IN-SITU EXTRACTION OF VISCOUS OIL BY GRAVITY ACTION USING STEAM PLUS SOLVENT VAPOR

FIELD OF THE INVENTION

This invention relates to a process for the recovery of highly viscous hydrocarbons from subterranean oil reservoirs. Specifically, the invention relates to continuously injecting steam and solvent while continuously producing oil and condensed steam from a single horizontal wellbore.

BACKGROUND OF THE INVENTION

World energy supplies are substantially impacted by the world's heavy oil resources. Indeed, heavy oil comprises 2,100 billion barrels of the world's total oil reserves. Processes for the economic recovery of these viscous reserves are clearly important.

Asphalt, tar, and heavy oil are typically deposited near the surface with overburden depths that span a few feet to a few thousands of feet. In Canada, vast deposits of heavy oil are found in the Athabasca, Cold Lake, Celtic, Lloydminster and McMurray reservoirs. In California, heavy oil is found in the South Belridge, Midway Sunset, Kern River and other reservoirs.

In large Athabasca and Cold Lake bitumen deposits oil is essentially immobile—unable to flow under normal natural drive primary recovery mechanisms. Furthermore, oil saturations in these formations are typically large. This limits the injectivity of a fluid (heated or cold) into the formation. Moreover, many of these deposits are too deep below the surface to be mined effectively and economically.

In-situ techniques of recovering viscous oil and bitumen have been the subject of much previous investigation. These techniques can be split into three categories: 1) cyclic processes involving injecting and producing a viscosity reducing agent; 2) continuous steaming processes which involve injecting a heated fluid at one well and displacing oil to another set of wells; and 3) the relatively new Steam (or Solvent) Assisted Gravity Drainage process.

Each of these techniques has large limitations if application to the very viscous Athabasca or Cold Lake reservoirs is desired.

Cyclic steam or solvent stimulation in these two reservoirs are severely hampered by the lack of any significant steam injectivity into the respective formations. Hence, in the case of vertical wells a formation fracture is required to obtain any significant injectivity into the formation. Some success with a fracturing technique has been obtained in the Cold Lake reservoir at locations not having any significant underlying water aquifer. However, if a water aquifer exists beneath the vertical well located in the oil bearing formation, fracturing during steam injection results in early and large water influx during the production phase. This substantially lowers the economic performance of wells. In addition, cyclic steaming techniques are not continuous in nature thereby reducing the economic viability of the process. Clearly, steam stimulation techniques in Cold Lake and Athabasca are severely limited.

Vertical well continuous steaming processes are not technically or economically feasible in the very viscous bitumen reservoirs. Oil mobility is simply far too small to be produced from a cold production well as is done in California type of reservoirs. Steam injection from one well and production from a remote production well is not possible unless a formation fracture is again formed. Formation fractures between wells are very difficult to control and there are operational problems associated with fracturing in such a controlled manner as to intersect an entire pattern of wells. Hence, classical steam flooding, even in the presence of initial fluid injectivity artificially induced by a fracture has significant limitations.

Steam Assisted Gravity Drainage (SAGD) is disclosed in U.S. Pat. No. 4,344,485 which issued to Butler in 1982. SAGD uses a pair of horizontal wells connected by a vertical fracture. The process has several advantages to steam stimulation or continuous steam injection. One advantage is that initial steam injectivity is not needed as steam rises by gravity above the upper well thereby replacing oil produced at the lower well. Another advantage is that since the process is gravity dominated and steam replaces voided oil, good sweep efficiency is obtained. Yet another advantage is since horizontal wells are utilized, good oil rates may be obtained by simply extending the length of the well to contact more of the oil bearing formation. In the SAGD process, steam is injected in the upper horizontal well while oil and water are produced at the lower horizontal well. Steam production from the lower well is controlled so that the entire process remains in the gravity dominated regime. A steam chamber rises above the upper well and oil warmed by conduction drains along the outside of the chamber to the lower production well. The process has the advantages of high oil rates and good overall recovery. It can be used in the absence of a vertical fracture.

However, one serious limitation of this process in practical application is the need to have two parallel horizontal wells—one beneath the other. Those skilled in the art of drilling horizontal wells will immediately recognize the difficulty in drilling two parallel horizontal wells, one above the other, with any real accuracy for any real horizontal distance from the surface.

Thus, what is needed is a process that provides the advantages of the Steam Assisted Gravity Drainage process but removes the difficulty of drilling two precisely spaced, parallel horizontal wellbores from the surface.

SUMMARY OF THE INVENTION

In accordance with the above stated need, an improved thermal recovery process for continuous steam and solvent injection along with concomitant oil production using a single horizontal wellbore is described. Steam passes out of slots along an upper portion of a horizontal wellbore containing two conduits or compartments. Steam percolates up through the formation. Oil flows downwardly both countercurrently and tangentially to the rising steam. Oil collects around the horizontal well where steam is continuously circulated. Steam circulates down the wellbore's outer compartment and back through its inner compartment. The inner compartment is open along a lower portion of the horizontal wellbore. Downwardly flowing oil from the reservoir collects in a pool around the wellbore and is pulled into the inner compartment along the length of the wellbore. Oil flow into the inner compartment is facilitated by conduction heating due to steam circulation throughout the apparatus.

Steam and a vaporous oil soluble solvent, such as $CO_2$, or $C_1$–$C_4$ hydrocarbons, are circulated through an outer compartment of a dual compartment single production/injection tubing string. Pressure of this outer compartment is controlled such that steam and oil soluble vapor flow, under the influence of gravity, into the hydrocarbonaceous fluid containing reservoir through slots along the top of the compartment. Steam and oil soluble vapor not taken by the formation are circulated back through the slotted second inner production compartment.

In the preferred embodiment of this process, warmed oil drains down through the viscous hydrocarbonaceous formation due to the action of gravity. It then collects in a pool around the wellbore. Vapor (steam and solvent) rises up through the liquid pool by gravity. Steam circulation within the wellbore provides heat to the oil pool surrounding the wellbore thereby further reducing its viscosity and facilitating its movement into the inner production compartment.

Steam and oil soluble vapor enter the formation: (1) at a rate dictated by the rate of oil drainage to the oil pool; (2) the rate at which oil and condensed water are withdrawn; and (3) the pressure of the outer compartment. A control scheme is utilized which limits the production of steam in the produced fluids such that the process is forcibly placed in a gravity dominated region. Therefore, the produced fluids do not contain large quantities of steam. Control is accomplished by raising the inner compartment's pressure when steam is sensed at the surface. Hence, steam is not permitted to flow directly from the outer, upper compartment or conduit of the horizontal wellbore to its lower, inner compartment or conduit. Steam only flows into the formation by purely gravitational forces away from the upper slots. Steam will alternately break through at the lower, inner compartment or conduit. However, by operating steam control effectively, the process will be controlled in the gravity dominated region.

A temperature gradient will be set up inside of the zone where steam is predominant as a result of solvent vapor diffusion within the steam zone. Solvent vapor tends to flow upwardly with the steam. When steam condenses the solvent vapor remains in the vapor phase. In general, a larger mole fraction of the solvent vapor will be collected at the surfaces of condensation near the steam/oil boundary. A diffusion of the solvent vapor in the direction opposite steam flow will occur resulting in a partial pressure gradient within the steam zone. Thus, the temperature of the steam zone will be largest near the wellbore and smallest at the outer boundary of the steam zone. This temperature gradient within the steam zone will facilitate stripping of the oil as it drains down through the steam zone. Lighter hydrocarbons will be stripped in the successively warmer zones within the steam zone.

It is therefore a primary object of this invention to provide an economically viable method for recovering initially immobile hydrocarbonaceous materials in reservoirs where fracturing is not an option due to an underlying water aquifer and dual, parallel horizontal wells are not practical.

It is another object of this invention to extract viscous hydrocarbonaceous materials with a gravity process using a single horizontal well.

It is yet another object of this invention to remove viscous hydrocarbonaceous materials from a subterranean oil reservoir by heated oil flow through and around steam rising by gravity through the formation above a single horizontal well.

It is still another object of this invention to utilize the countercurrent nature of flow within the reservoir to extract lighter ends of heavy crude thereby providing for an in-situ separation process.

It is still yet another object of this invention to provide for a continuous thermal oil production process from a single horizontal wellbore.

It is a further object of this invention to provide for an oil production process which substantially reduces sand production during oil inflow.

DESCRIPTION OF THE PREFERRED EMBODIMENTS

This invention is directed to a method for removing immobile viscous hydrocarbonaceous fluids from a formation or reservoir which formation is penetrated by a horizontal wellbore. The horizontal wellbore contains a lower or inner conduit 1 and an outer or upper conduit 2. Placed within the outer conduit 2 along its horizontal length are perforations 3. Lower conduit 1 is open along its bottom or lower side through an opening 9. The relationship between the lower conduit 1 and outer or upper conduit 2 is shown in a cross-sectional view of FIG. 1.

Figure 2:
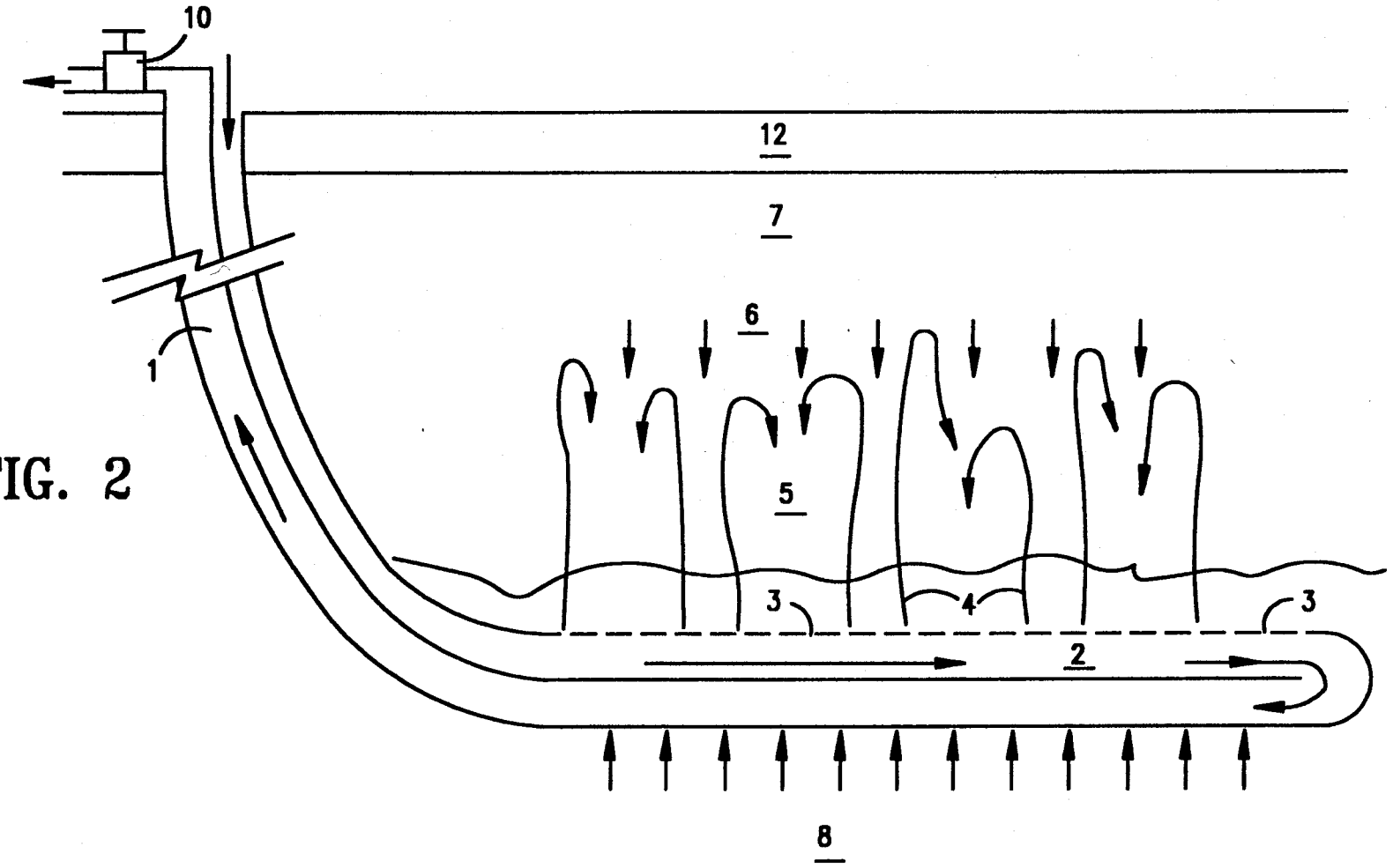
FIG. 2 depicts a schematic longitudinal sectional view of a horizontal wellbore utilized in carrying out the process of this invention.

In the practice of the invention, referring to FIG. 2, steam and a gas soluble in hydrocarbonaceous fluids are circulated down outer or upper conduit 2. Steam and the gas are continually circulated into outer compartment 2 at a pressure at or below the reservoir pressure but also below the reservoir's fracture pressure. In this manner pressurized steam entry into the reservoir is substantially avoided. Steam flows into the formation by purely gravitional forces away from upper perforations 3. Additionally, steam when circulated in this manner heats the area surrounding the wellbore by conduction heating. Gas circulated into upper or outer compartment 2 enters the formation by diffusion so as to enhance the reduction in viscosity of the hydrocarbonaceous fluids.

Steam is allowed to continually circulate in and out of the horizontal wellbore for a time sufficient to heat the reservoir by transient conduction. The reservoir is heated to a temperature sufficient to cause the hydrocarbonaceous fluids to become reduced in viscosity and thereby move to a lower section of the wellbore where said fluids exit the reservoir via opening 9 along the lower or inner compartment 1 of said wellbore. These hydrocarbonaceous fluids of reduced viscosity are continually removed from the reservoir via opening 9 in lower or inner conduit 1. A wellbore configuration which can be used in the practice of this invention is disclosed in U.S. Pat. No. 4,067,391 which issued to Dewell on Jan. 10, 1978. This patent is hereby incorporated by reference herein.

Steam and soluble gas circulation into outer or upper conduit 2 is controlled by control valve 10. Gases soluble in hydrocarbonaceous fluids which can be used herein include carbon dioxide, nitrogen, flu gas, and $C_1$–$C_4$ hydrocarbons. Once hydrocarbonaceous fluids of reduced viscosity begin to move from the reservoir, pressure within the outer or upper conduit 2 is controlled so that steam and gas soluble in hydrocarbonaceous fluids flow, under the influence of gravity, into the reservoir through wellbore perforations 3. Steam and gases that are not taken into the formation are circulated back through inner or lower compartment 1 where they exit the horizontal wellbore to the surface. While the warmed hydrocarbonaceous fluids of reduced viscosity drain downwardly through viscous hydrocarbonaceous fluids contained in the reservoir by gravity action, a hydrocarbonaceous fluid pool forms around the horizontal wellbore.

Figure 1:
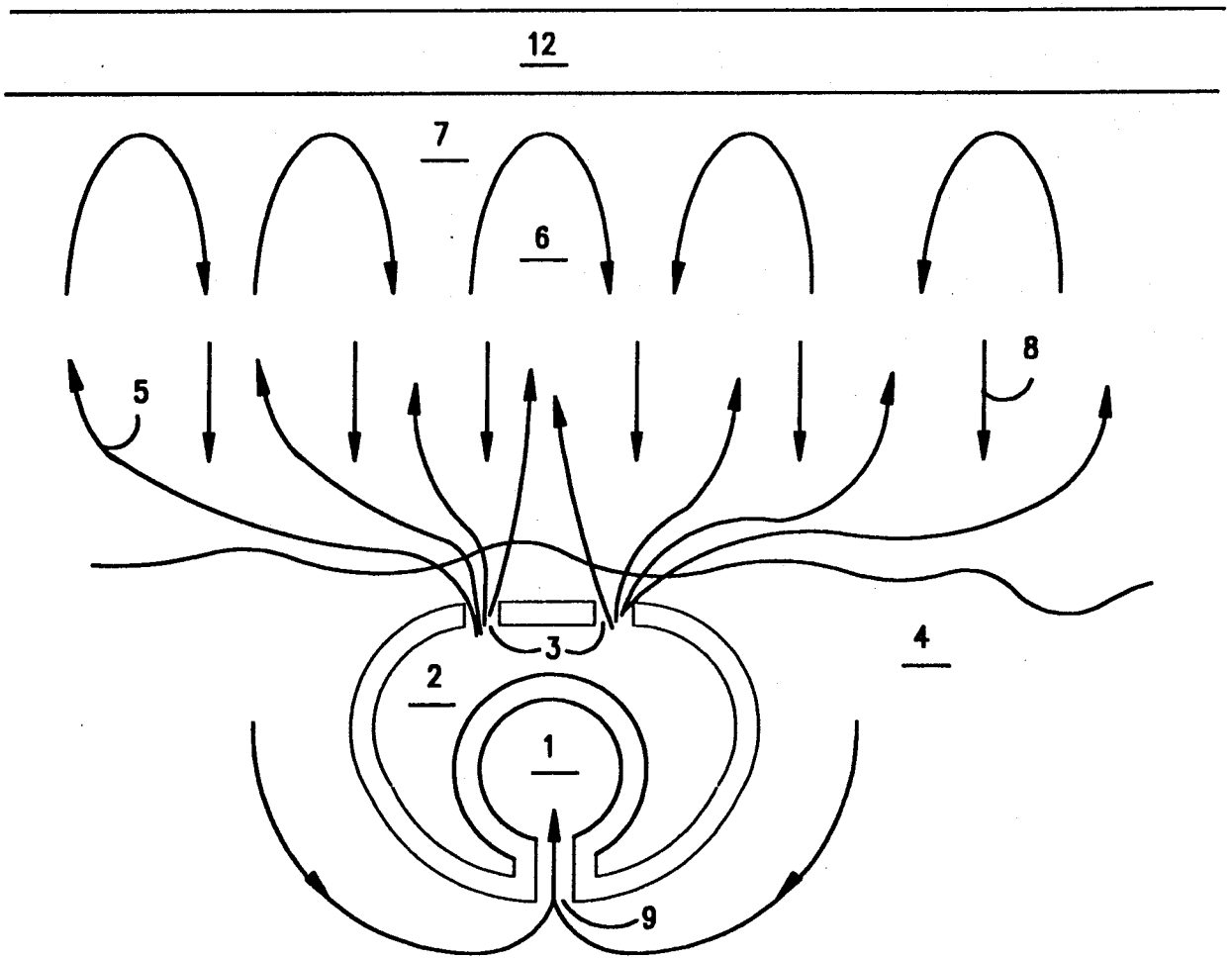
FIG. 1 is an enlarged cross-sectional view of a horizontal wellbore oriented perpendicular to the direction of flow within the wellbore.

As is shown in FIGS. 1 and 2, steam and gas which have not been taken up by the hydrocarbonaceous fluids in the reservoir tend to flow downwardly into pool 4 which surrounds the wellbore whereupon they enter opening 9 in lower or inner conduit 1. Steam circulation within the wellbore provides heat to pool 4 surrounding said wellbore which facilitates the oil's movement into lower or inner conduit 1 where it is produced to the surface.

Steam and gases are taken by the formation or reservoir at a rate which is dictated by the rate of oil drainage int pool 4. The rate at which hydrocarbonaceous fluids and condensed steam are withdrawn is controlled by the pressure in outer or upper conduit 2. The process is controlled so as to limit the production of steam in fluids produced to the surface so that the process is forcibly placed in a gravity dominated area. In this manner produced fluids do not contain large quantities of steam. This control is maintained by raising the pressure within the inner or lower compartment 1 when steam is sensed at the surface. Therefore, steam is not permitted to flow directly from outer or upper conduit 2 into lower or inner conduit 1. Steam can only flow into the reservoir or formation away from upper perforations 3 which is accomplished by pure gravity while the process is being utilized. Steam will alternatively break through at lower or inner conduit 1. By operating steam control effectively, the process can be controlled so that gravity influences a flow of viscous fluids so as to maintain a pool of oil or hydrocarbonaceous fluids around a horizontal wellbore.

Although the horizontal length of the wellbore can be modified as desired, as is preferred, the wellbore has a length of about 3,000 feet. Hydrocarbonaceous fluids within the reservoir include tar sands, asphalt, or other viscous hydrocarbonaceous fluids. Steam is allowed to circulate within the horizontal wellbore for a period of about 35 days or more. Steam injection into the reservoir is substantially avoided by maintaining a steam circulation rate in the range of about 100 barrels per day to about 200 barrels per day cold water equivalent (CWE) for about 35 days. As shown in FIGS. 1 and 2, steam 5 exits outer or upper compartment 2 by perforations 3. As the steam 5 and soluble gases exit perforations 3 into the formation or reservoir, some steam and vapor condense and begin to flow downwardly from steam zone 7 in said reservoir. Warmed oil of reduced viscosity 8 flows down and forms a pool 4 around the horizontal wellbore. As the warmed oil of reduced viscosity flows downwardly, both tangential and countercurrent flow of oil and vapor occur. As warmed oil 8 drains downwardly, a more easily vaporized fraction of the hydrocarbonaceous fluids is stripped off and rises upwardly along with steam and the gas soluble in hydrocarbonaceous fluids. This fraction dissolves in the oil at a steam and gas interface at the top edges of the steam zone and results in a further viscosity reduction of the hydrocarbonaceous fluids or oil.

Since oil in the near wellbore region is warmed substantially by conduction heating, oil infill pressure gradients are much lower. As mentioned above, in U.S. Pat. No. 4,067,391 heating of the near wellbore region is expected to result in reduced sand production. Since the near wellbore region in the practice of this invention is heated to a much higher temperature due to steam circulation, higher inner wellbore temperatures are obtained, thus, reduced sand production is expected.

Oil warmed by conduction in the near wellbore region flows under the influence of gravity into inner or lower compartment 1 along opening 9 therein. Oil of reduced viscosity is brought to the surface by steam lift of the produced fluids. Thus, a continuous oil production process, aided by conduction heating in the near wellbore region, and driven by a gravity dominated steam zone, is obtained.

While not desiring to be held to a particular theory, it is believed steam and the gases soluble in hydrocarbonaceous fluids circulate into the horizontal wellbore. Since the steam and gas have a small density relative to hydrocarbonaceous fluids in the formation, steam and gas tend to rise upwardly by gravity. Initially, as shown in FIG. 2, steam migration into the reservoir may be aided by mild pressure increases within outer or upper conduit 2. As steam moves upwardly in the reservoir, warmed oil drains downwardly both within and external to steam zone 7. Steam which passes out of upper perforations 3 forms a zone predominantly of steam and gas thereby making a vapor solvent 6. As the steam rises it liberates its heat by condensing at the upper portion of steam zone 7. Oil warmed by condensing steam and gas vapor drains downwardly through vapor solvent zone 6. As it drains, the lighter and more volatile portion of the hydrocarbonaceous fluids is stripped off. As steam and the solvent vapor rise through steam zone 7, a vapor solvent gradient is created due to collection of the non-condensible vapor at the surfaces of condensation along upper portion of steam zone 7. Warmed oil 8 flowing downwardly collects around the wellbore thereby forming pool 4.

Since the process is forced into a gravity dominated mode by controlling steam production, oil 4 surrounds the wellbore instead of steam. A gravity head operates on oil pool 4 to provide a driving force for flow into opening 9 within lower or inner conduit 1. Oil within pool 4 thus flows into opening 9 and into inner or lower conduit 1. Oil, steam, and water are then brought to the surface by steam lifting imparted by the fluids. Oil flow into horizontal wellbore under the influence of conduction heating is made substantially easier. The following equation will aid in understanding the theory.

This equation below can be derived for estimating the productivity, $q_o$, of a well system where conduction aids oil inflow:

$$q_o = \left(\frac{2\pi L\alpha}{m}\right) \cdot \frac{\ln\left[1 + \frac{mk}{\alpha\mu_o}(P_e - P_w)\right]}{\ln\left(\frac{r_e}{r_w}\right)}$$

Using this equation it is estimated that oil rates in the range of 0.12 barrel per foot per day for a reservoir may be obtainable. Thus, a 2,000 foot horizontal wellbore completed in the formation should have an oil rate of 240 barrels per day. This equation does not explicitly account for the gravity driving force, however, $P_e - P_w$ may be thought of as the total driving force of pressure and gravity into the wellbore. Furthermore, due to the assumptions made, the equation may not apply to the process described herein in a direct manner. It only provides evidence of the enhanced effect on oil rate when conduction heating is present.

In the operation of the preferred embodiment of this invention as shown in FIG. 2, production of steam is controlled by closing and opening control valve 10. If steam production becomes excessive, control valve 10 is choked back raising the pressure along the entire wellbore apparatus and preventing steam bypassing from the top slots to the bottom opening.

Obviously, many other variations and modifications of this invention as previously set forth may be made without departing from the spirit and scope of this invention as those skilled in the art readily understand. Such variations and modifications are considered part of this invention and within the purview and scope of the appended claims.

I claim:

1. A method for removing immobile viscous hydrocarbonaceous fluids from a formation or reservoir penetrated by a horizontal wellbore, comprising:

a) circulating continuously in and out of said horizontal wellbore steam and a gas soluble in hydrocarbonaceous fluids through an upper perforated conduit of said horizontal wellbore and exiting through a lower conduit via a pressure at or below the reservoir pressure and below the reservoirs's fracture pressure so as to substantially avoid steam entry into the reservoir except by gravitational forces, thereby conduction heating the reservoir while obtaining by steam percolation and gas diffusion into the formation an enhanced reduction in the viscosity of hydrocarbonaceous fluids; and b) allowing steam to circulate in and out of said wellbore for a time sufficient to heat the reservoir by transient conduction to a temperature sufficient to remove continuously hydrocarbonaceous fluids of reduced viscosity from said lower conduit in said wellbore which fluids result from conduction heating, steam percolation and gas diffusion into the reservoir.

2. The method as recited in claim 1 where the lower conduit is open along its horizontal length so as to be in fluid communication with said reservoir.

3. The method as recited in claim 1 where the gas which is soluble in hydrocarbonaceous fluids is selected from a member of the group consisting of carbon dioxide, nitrogen, flue gas, and $C_1$ through $C_4$ hydrocarbons.

4. The method as recited in claim 1 where in step b) the steam circulates in said wellbore for about 35 days.

5. The method as recited in claim 1 where steam circulation rates range from about 100 BBL/day to about 200 BBL/day (CWE) for about 35 days.

6. The method as recited in claim 1 where the immobile viscous hydrocarbons comprise tar sands or asphalt.

7. The method as recited in claim 1 where the horizontal well is up to about 3,000 feet in length.

8. The method as recited in claim 1 where production of steam in the produced fluids is such that a gravity dominated region exists around said wellbore.

9. The method as recited in claim 1 where in step a) steam and said gas not taken in by the formation are circulated back into the wellbore through a slot contained in the lower conduit.

10. The method as recited in claim 1 where pressure in the lower conduit is raised when steam is sensed at the surface, thus preventing steam from flowing directly from the upper conduit to the lower conduit.

11. The method as recited in claim 1 where sand production is substantially reduced while producing hydrocarbonaceous fluids from said reservoir.

12. The method as recited in claim 1 where steam and said gas enter the reservoir at a rate dictated by a rate of hydrocarbonaceous fluid drainage and withdrawal from the reservoir in conjunction with pressure in the upper conduit.

* * * * *